US005829776A

United States Patent [19]

Deville et al.

[11] Patent Number: 5,829,776

[45] Date of Patent: Nov. 3, 1998

[54] DEVICE FOR CROSS COUNTRY SKI AND SKI EQUIPPED WITH SUCH A DEVICE

[75] Inventors: Dominique Deville, Annecy Le Vieux; Jacques Quellais, Saint-Jorioz, both of France

[73] Assignee: Salomon S.A., Metz-Tessy, France

[21] Appl. No.: 438,965

[22] Filed: May 11, 1995

[30] Foreign Application Priority Data

May 11, 1994 [FR] France ..... 94 05952

[51] Int. Cl.[6] ..... A63C 5/07

[52] U.S. Cl. ..... 280/602; 280/607; 280/615

[58] Field of Search ..... 280/602, 607, 280/609, 615

[56] References Cited

U.S. PATENT DOCUMENTS

| | | | |
|---|---|---|---|
| 1,664,972 | 4/1928 | Dudderar . | |
| 1,774,819 | 9/1930 | Walters et al. . | |
| 5,292,147 | 3/1994 | Bejean | 280/602 |
| 5,427,400 | 6/1995 | Bejean | 280/602 |

FOREIGN PATENT DOCUMENTS

| | | |
|---|---|---|
| 0473898 | 3/1992 | European Pat. Off. . |
| 2666021 | 2/1992 | France . |
| 391387 | 9/1965 | Gambia . |
| 36 28911 A1 | 3/1988 | Germany . |
| 4240342 | 2/1994 | Germany . |
| 9317689 | 3/1994 | Germany . |

*Primary Examiner*—Brian L. Johnson
*Assistant Examiner*—Michael Mar
*Attorney, Agent, or Firm*—Greenblum & Bernstein, P.L.C.

[57] ABSTRACT

An assembly adapted for use in skiing, particularly alternating steps skiing. The assembly includes in particular a ski and an assembly for increasing the rigidity in flexion of the ski, in a manner so as to preserve or increase the lifting in the vertical direction of the lower surface of the ski, at least in a portion of the gripping zone, during the lowering of the heel of the foot. This assembly includes in particular a plate, positioned above the upper surface and maintained by linkage elements.

40 Claims, 11 Drawing Sheets

101
107
103
120
145
102
P1
146
105
106

145
111
112
111 b
110
103 b
113
114
108
P2
105
103 a
106

DEVICE FOR CROSS COUNTRY SKI AND SKI EQUIPPED WITH SUCH A DEVICE

BACKGROUND OF THE INVENTION

1. Field of the Invention

The present invention relates to gliding sports, such as skiing.

The invention relates more particularly to an assembly adapted to the practice, permanently or temporarily, of alternating steps, such as that practiced in particular in cross country skiing, in back country skiing or in telemark.

2. Discussion of Background and Material Information

A ski adapted for the practice of alternating steps comprises, in a general manner, an upper surface, a lower surface, two end zones forming a heel and a tip, and a central zone defining in particular a gripping zone or a wax chamber.

During the exercise of alternating steps, the skier executes a movement resembling that of walking, in that each foot is alternately in support at the level of the metatarso-phalangian journal or in support at the level of the heel, on the upper surface of the ski.

The metatarso-phalangian support corresponds to an impulse phase given by the skier for the forward progression, and defines an impulse support zone. It is at the level of this zone that a maximum force is exerted to bring the central zone of the lower surface of the ski into contact with the snow.

The heel support corresponds to a gliding phase during which the central zone is spaced from the snow.

The alternating step thus translates into a successive lowering and raising of the gripping zone. It is of first order of importance that the lowering occurs easily to make it possible to obtain a substantial contact pressure of the gripping zone on the snow, and it is also of first importance that the raising likewise occurs easily so as to avoid any contact of the gripping zone with the snow during the gliding phase.

Indeed, the principal function of the gripping zone is to prevent the ski from retreating during the impulse phase. This zone can be covered by a retention wax, scales, a seal skin, an anti-retreating chemical covering or any other means.

But the gripping zone must not touch the ground during the gliding phase, in a manner so as to not rub the wax or the other means, which would be prejudicial to long-term use or to a good quality of gliding.

The traditional prior art has indeed taken into account this problem of the quality of the glide, and generally proposes skis whose arched profile defines an upward camber, and well maintains the gripping zone spaced from the ground during the gliding phase. However, a substantial disadvantage of traditional skis is that the skier must have a good movement dynamic to act on the camber of the ski and to press the gripping zone to the ground. As a result, the impulse is not generally strong enough and the ski has a tendency to retreat during the impulse phase.

A more recent prior art technique has attempted to overcome this disadvantage by proposing a ski whose rigidity in flexion is reduced with respect to traditional skis. It is the case of the ski proposed by Salomon in French Patent No. 2,666,021, where a transverse slit is provided in the central zone of the ski, substantially between the upper surface and the lower surface. This ski, whose rigidity in flexion is reduced by the slit, makes it possible for the skier to flatten the gripping zone to the ground with much ease. An advantage is that the ski no longer retreats during the impulse phase. However, the reduced rigidity of the weakened ski does not make it possible for it to recover the necessary camber for the gliding phase. As a result, an excessive friction occurs during this latter phase, which causes the removal of the wax of the wax chamber and/or a substantial braking effect.

Furthermore, such a weakened ski has a very short life, because the lack of cohesion of the structure of the ski in the vicinity of the slit causes its rapid deterioration.

SUMMARY OF THE INVENTION

The aim of the present invention is to overcome these disadvantages and to provide an assembly adapted for the practice of skiing, making it possible to reduce the efforts to be exerted by the skier to press the gripping zone to the ground during the impulse phase, while recovering the camber during the gliding phase, without prejudicing the product life of the ski.

To this end, the invention proposes an assembly adapted for the practice of skiing, in particular in alternating steps, comprising a ski adapted to receive the foot of the skier, and having an upper surface, a lower surface, two end zones constituting a heel and a tip, a central zone defining in particular a gripping zone or wax chamber, as well as means increasing the rigidity in flexion of the ski in a manner so as to preserve or increase the lifting in the vertical direction of the lower surface of the ski at least in a portion of the gripping zone, during the lowering of the heel of the foot.

Such an assembly is dynamic in the sense that its rigidity in flexion varies during its utilization by the skier on the ground which is preferably covered with snow, as a function of the forces exerted by the skier.

The means for maintaining or lifting the gripping zone of the ski comprise in particular a plate, positioned above the upper surface and maintained substantially in the central zone of the ski by a front linkage and by a rear linkage.

These linkages can be abutments, between which the assembly plate is immobilized. When the foot is flat, i.e., supported on the heel, the plate is maintained against the ski; the assembly is then rigid and the ski is cambered, allowing for an optimal gliding. Conversely, when the foot is supported only at the level of the metatarsus subsequent to the lifting of the heel, the plate deforms with the ski and the ski is pressed to the ground, allowing for an optimum impulse grip.

The plate allows the assembly to be rigid if the skier is supported on the heel, but it does not disturb the flexion of the ski when the skier is supported on the metatarsus.

The assembly has all of the advantages of the prior art without suffering the disadvantages thereof.

Furthermore, the plate can be prestressed in the direction of its length, as a function of the desired rigidity of the assembly.

If the length of the plate is equal to the distance between the linkage means and the abutments, the plate is not prestressed. In this case, the assembly obtained is well appropriate for use by a skier of modest level.

If the length of the plate is greater than the distance between the linkage means, the plate is prestressed. In this case, the assembly is more rigid and well adapted to a competition skier.

However, whether the plate is prestressed or not, the ski according to the assembly can preferably have at least one variation in rigidity in flexion in the central zone.

In this manner, the flexion of the ski occurs more easily and the wax chamber is better pressed to the ground during the impulse phase, without the rigidity of the assembly being changed in heel support, because it is the plate which then gives the ski its camber.

In view of the foregoing, the invention is directed to a cross-country ski assembly which includes a ski and a rigidification device, whereby the ski includes an upper surface and a lower surface, defining a central zone, in which the ski has a structure whereby the lower central zone is adapted to be spaced from the ground or snow in the absence of a predetermined vertical load applied to the upper surface of the ski, and whereby the rigidification device includes at least one plate having opposite extremities, each of the opposite extremities of the plate being linked to the upper surface of the ski.

More particularly, the invention is directed to an assembly to be used for cross-country, skiing, including a gliding phase and an impulse phase, in which the rigidification device is dynamic, i.e., whereby the device establishes a rigidity higher than a predeterminate rigidity during the gliding phase and for resuming the predeterminate rigidity during the impulse phase. The dynamic rigidification device can include at least one plate positioned above the upper surface of the ski and linkages for linking the front and rear ends of the plate to the ski.

According to another definition of the invention, the invention is directed to a cross-country ski assembly for practicing cross-country skiing, i.e., including a gliding phase and an impulse phase, in which the assembly includes (1) a ski having a predeterminate camber and a predeterminate rigidity in flexion, whereby the gripping zone of the ski is adapted to be spaced from a ski supporting surface during the gliding phase, as the heel of the skier is lowered toward the support surface, and the gripping zone is adapted to contact the ski supporting surface during the impulse phase, as the heel of the skier is raised from the support surface, and (2) a rigidification device including at least one plate having opposite extremities and linkages for linking respective ones of the extremities of the plate to the upper surface of the ski, the rigidification device and the ski having a rigidity in flexion during the gliding phase that is greater than the aforementioned predeterminate rigidity of the ski.

BRIEF DESCRIPTION OF THE DRAWINGS

Other characteristics and advantages of the invention will become clear from the description which follows with reference to the annexed drawings, in which.

DETAILED DESCRIPTION OF THE PREFERRED EMBODIMENTS

Figure 1:
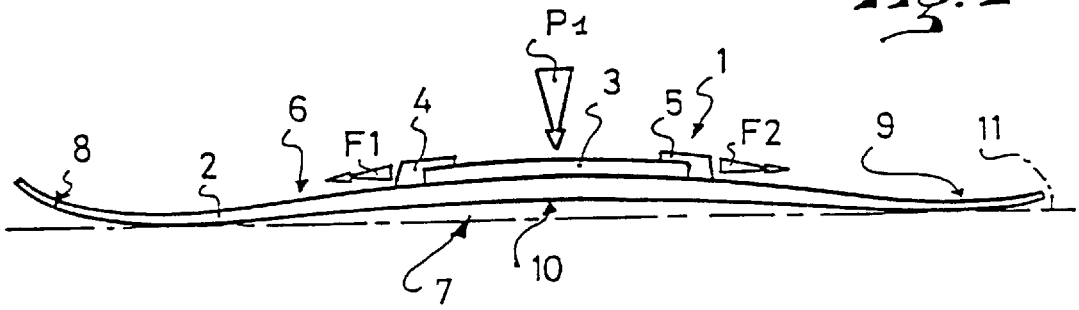
FIG. 1 shows an assembly comprising a ski in the gliding phase.

FIG. 1 schematically illustrates an assembly 1 composed in particular of a ski 2 and a plate 3 affixed on the ski 2 by means of a front linkage 4 and a rear linkage 5.

The ski 2 comprises an upper surface 6, a lower surface 7, a front end or tip 8, a rear end or heel 9, as well as a central zone defining on the lower surface 7 a gripping zone or wax chamber 10 directly below which plate 3 is disposed.

Ski 2 of assembly 1 of FIG. 1 is shown in a side view in a position which corresponds to a gliding phase. In such a case, ski 2 is supported on ground 11, schematically shown by dashed lines, only by contact of heel 9 and tip 8. The wax chamber 10 is spaced from ground 11. Plate 3 is substantially parallel to the upper surface 6 of ski 2.

This situation occurs when a foot, not shown in FIG. 1, is flat on the ski, supported at the heel, and resting substantially downwardly in a manner such that the plate 3 is maintained in the vicinity of the upper surface 6 of the ski 2.

Force P1, exerted by the foot on plate 3 in a substantially vertical descending direction, is transferred in part to the front linkage means 4 and in part 2 to the rear linkage means 5, the transfer being translated into forces F1 and F2.

These forces F1 and F2 are exerted respectively on the front linkage means 4 and rear linkages 5, in a manner such that the said linkage means 4 and 5 have a tendency to be moved away from one another. As these linkages 4 and 5 are both affixed to the upper surface 6 of ski 2, their spacing caused by the forces F1 and F2 generates an elongation of the upper surface 6 of ski 2. This elongation gives the ski 2 a camber which is substantial especially as plate 3, positioned above the upper surface 6, is maintained substantially in the central zone of ski 2 by front and rear linkages, respectively 4 and 5.

By application on plate.3, the force P1 exerted by the foot of the skier at the level of the heel has acted to increase the rigidity in flexion of ski 2 in a manner so as to preserve or increase with respect to the ground 11 the lifting in the vertical direction of the lower surface 7 of the ski 2, i.e., the camber of the ski, at least in a portion of the gripping zone 10, and thus allows for an optimum gliding phase.

Figure 2:
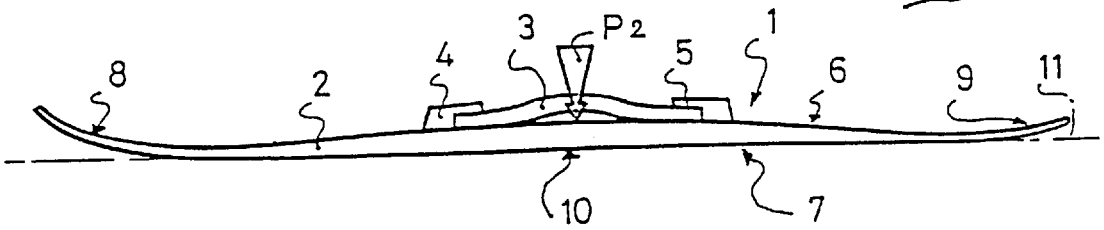
FIG. 2 shows an assembly comprising a ski in the impulse phase.

Conversely, when the force no longer maintains plate 3 in contact with the upper surface 6 of the ski 2, as is shown in FIG. 2 which corresponds to an impulse phase during which the skier exerts a force P2 only at the level of the metatarsus of the foot, while the plate 3 deforms to space itself from the upper surface 6, over at least a portion of its length, without disturbing the flattening of the ski.

The linkages 4 and 5 come towards one another at the same time as the gripping zone 10 of ski 2, comes into contact with the ground 11.

Assembly 1 thus acts as a dynamic system which oscillates between two extreme positions, one being that of the gliding phase and the other being that of the impulse phase.

It is possible to modify the behavior of the assembly by adapting the length d1 of plate 3 of front end 12 and rear end 13, with respect to the distance d2 of separation of the linkages 4 and 5.

Figure 3:
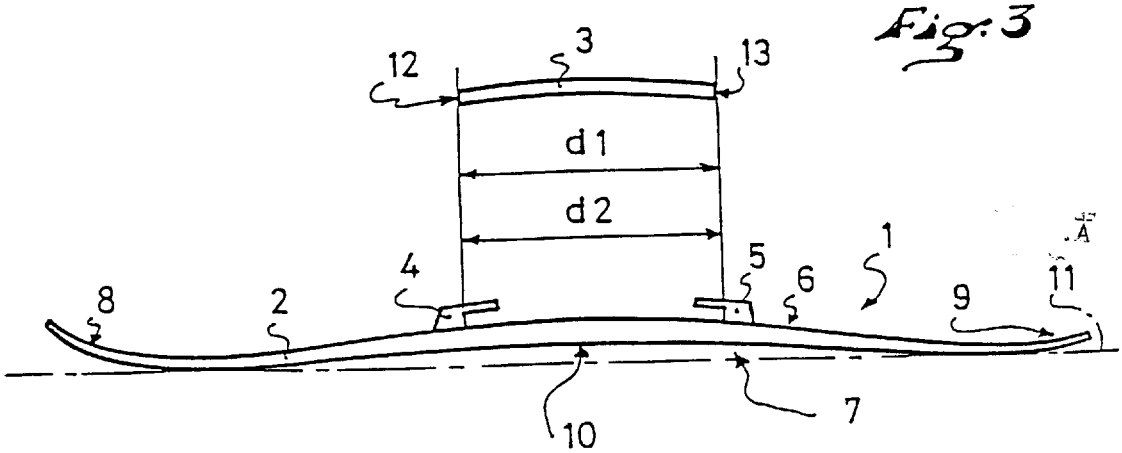
FIG. 3 shows a comparison of the length of the plate with respect to the distance separating the linkage means.

The dimensions d1 and d2 are shown in FIG. 3.

In the case where the lengths d1 and d2 are identical, when they are measured on the one hand on plate 3 taken alone, and on the other hand between the linkages 4 and 5 affixed to the ski without the presence of the plate, such that the plate 3 is not prestressed in the longitudinal direction, then assembly 1 makes it possible for the skier:

To strongly press the wax chamber 10 on the ground 11 during the impulse phase, since the non-prestressed plate 3 does not increase the stiffness of the ski during this phase, by a force P2 exerted at the level of the metatarsus;

And to maintain this wax chamber 10 spaced from the ground 11, during the gliding phase, by a force P1 applied at the level of the heel.

In this case, the linkages 4 and 5 can be constituted by simple abutments in the vertical and longitudinal direction.

An advantage is that these two characteristics of support and maintenance in a position spaced from the wax chamber 10 are obtained on the same assembly 1. It follows that the same ski 2 is optimized and grips the snow well during the impulse phase, without losing its wax or without wearing down its scales in the gliding phase.

Another advantage is that the forces P1, P2, exerted by the skier cause no fatigue for the skier, because the force is all of or partially the weight of the skier and does not result from a supplemental impulse as supplied by the skier. Consequently, the dynamic assembly 1 is well suited to a skier of low ability or not well trained, or a skier who advances on a hilly ground.

Another case comprises selecting a length d1 slightly greater than the length d2 such that the plate 3 is prestressed in the longitudinal direction. In this configuration, the assembly 1 functions in a manner similar to the preceding case. However, the difference between the lengths d1 and d2 make it such that in the gliding phase, the linkages 4 and 5 are biased, and thus more spaced; the forces F1 and F2 are greater and the ski 2 cambers itself more for the same effort P1.

It follows on the other hand that the skier must exert a greater force P2 during the impulse phase to preserve good contact of the wax chamber 10 on the ground 11. Indeed, the prestress in the plate 3, corresponding to the difference in lengths d1 and d2, has rendered assembly 1 more rigid in flexion than is the case where d1 is equal to d2.

This assembly 1 which is more rigid is appropriate for skiers of a high of ability and may be used in competition, because it has the advantage of functioning well when the alternating step is practiced at an elevated rhythm, as is the case during sporting events.

Assembly 1 thus has the advantage of being able to satisfy all types of skiers, by assuring a good gripping of the ground and a good gliding whatever the conditions of use. It suffices that the lengths d1 and d2 be adapted to the conditions of use of assembly 1.

An adjustment mechanism 14 can be provided for better adapting the values d1 and d2 which respect to one another.

Figure 4:
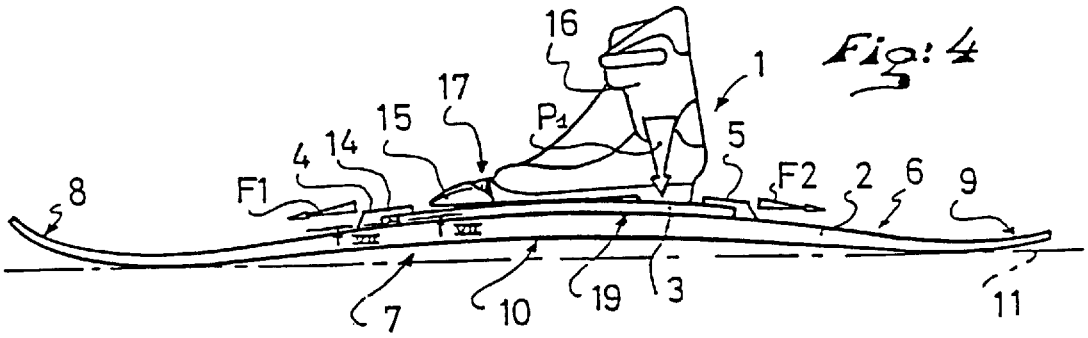
FIG. 4 shows a shoe supported on an assembly in the gliding phase.

Such an adjustment mechanism 14 can for example be positioned between front abutment 4 and plate 3, as is shown in FIG. 4.

The adjustment mechanism 14, whose mode of operation will be explained below, allows for an adjustment in the longitudinal direction of the prestressing of plate 3.

Assembly 1 equipped with adjustment mechanism 14 according to FIG. 4 corresponds to a gliding phase, as for FIG. 1.

A binding 15, affixed for example on plate 3 by any means known to those of skill in the art, connects a shoe 16 for example through an axis 17 in a manner such that the shoe 16 can press on plate 3. The principle remains the same as in the case of FIG. 1 previously described.

Figure 5:
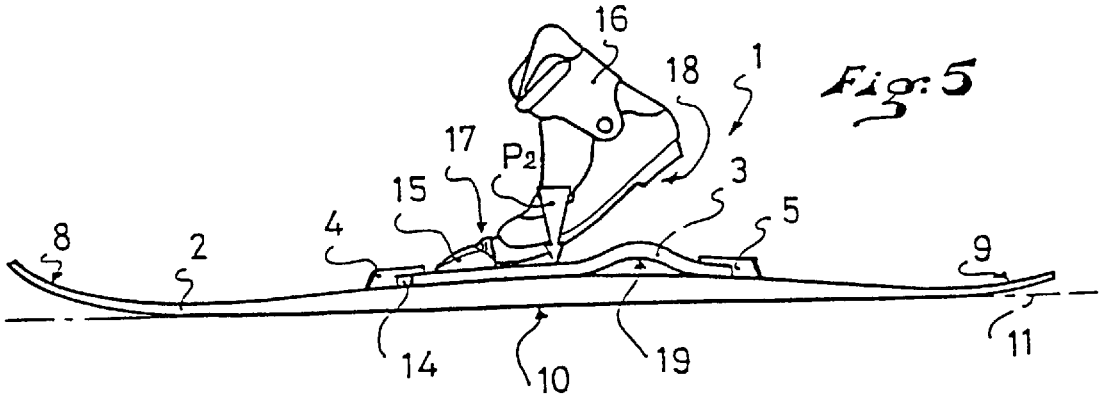
FIG. 5 shows a shoe supported on an assembly in the impulse phase.

Assembly 1 as shown in FIG. 5 corresponds to an impulse phase. In this case, heel 18 of shoe 16 is lifted with respect to plate 3, which makes it possible for the front of the foot to press downwardly, by exerting a force P2, to press the wax chamber 10 on the ground 11, while permitting plate 3 to deform over at least a portion of its length, as in the case of FIG. 2.

Figure 6:
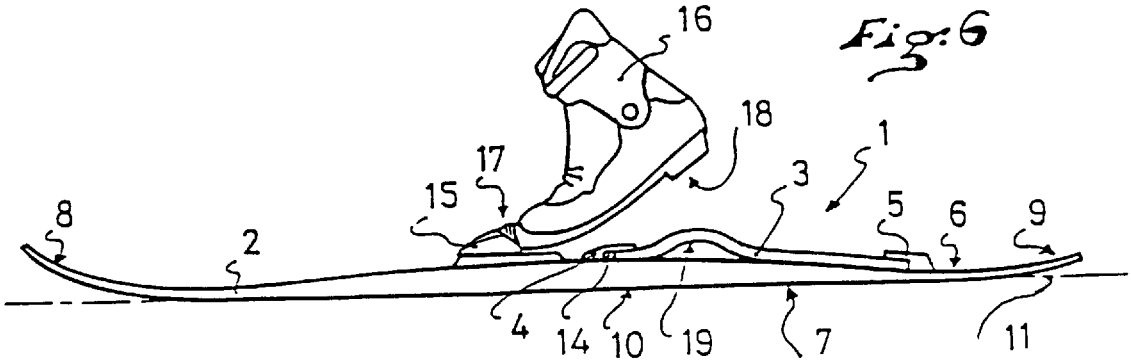
FIG. 6 shows an alternative embodiment of the assembly.

FIG. 6 shows an alternative embodiment for which binding 15 is directly connected to the upper surface 6 of ski 2. Plate 3, abutments 4 and 5 and adjustment mechanism 14 are positioned slightly to the rear on ski 2.

The operation is similar to the preceding case. It is important that plate 3 cause the raising of the ski 2 at the level of the wax chamber 10.

As has been said, this being true whatever embodiment is selected, the adjustment mechanism 14 will advantageously make it possible to adapt a single assembly 1 to different styles of use by the skier.

A first solution comprises simply eliminating any operational play between front abutment 4, adjustment mechanism 14, plate 3 and rear abutment 5, in a manner such that no force is applied on the plate in a substantially longitudinal direction. The absence of this play is easily located: it suffices to consider assembly 1 at rest, i.e., resting flat on ground 11, without contact with the shoe of the skier.

The play is zero when lower surface 19 of plate 3 is substantially in contact with upper surface 6 of ski 2.

This embodiment is very appropriate for a skier of low ability level and corresponds to the case explained previously where d1 equals d2, i.e., to the absence of prestress in plate 3.

Now, a second solution comprises making it such that a prestress is exerted on plate 3 in a substantially longitudinal direction.

In this case, the length d1 of plate 3 is slightly greater than the distance d2 between the abutments 4 and 5, and the prestress causes, in the absence of any bias of plate 3, a deformation in the plate 3. The deformation is small when the heel presses downwardly, and it is greater when an impulse is given by the skier at the level of the metatarsus.

This embodiment is very appropriate for a skier of high ability level as has been said.

Figure 7:
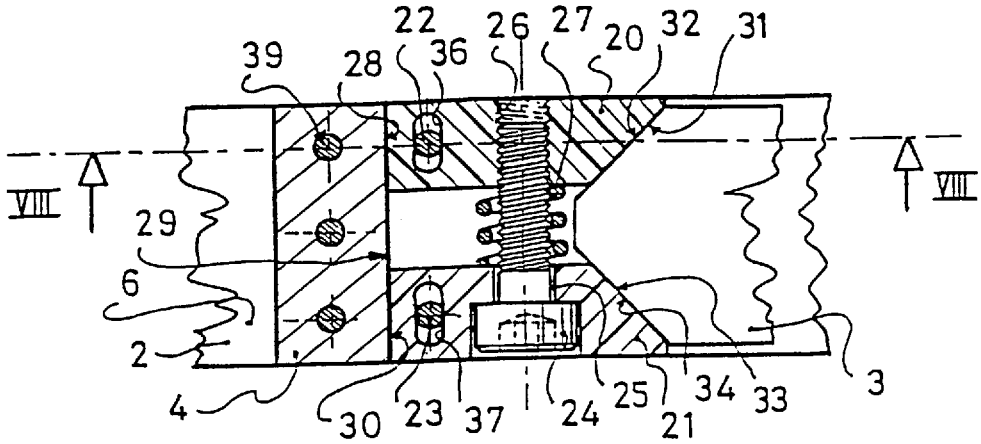
FIG. 7 is a cross section along VII—VII of FIG. 4.
Figure 8:
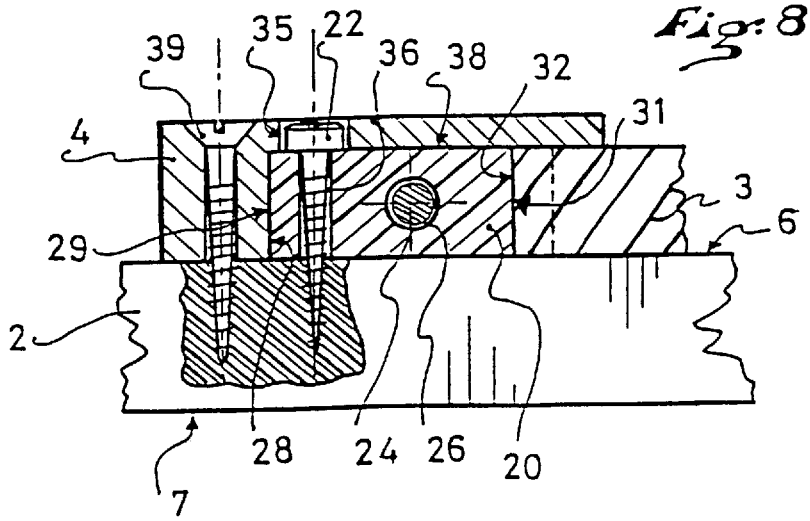
FIG. 8 is a cross section along VIII—VIII of FIG. 7.

The adjustment mechanism 14 comprises, according to a non-limiting example whose two cross-sectional views are shown in FIGS. 7 and 8, two movable cams 20 and 21 positioned between linkages 4 and 5 and plate 3, and two blockage elements 22 and 23, which make it possible to immobilize each cam 20 and 21 in a desired position.

The cross-section of FIG. 7 is substantially parallel to the upper surface 6 of ski 2. An adjustment screw 24 extends through cam 21, by passing into a smooth hole 25 in cam 21, to reach a threaded hole 26 of cam 20.

A spring 27 extending in the direction of the length by the screw 24 is likewise situated between the cams 20 and 21 which it spaces one from the other.

A rotation in either direction of the adjustment screw 24 makes it possible to bring close or to distance cams 20 and 21 with respect to one another.

Cam 20 is supported by a surface 28 on a surface 29 of abutment 4.

Cam 21 is supported by a surface 30 on a surface 29 of abutment 4.

Cam 20 is bevelled and comes into contact with an inclined surface 31 of plate 3, through a surface 32. Cam 21 is bevelled and comes into contact with an inclined surface 33 of plate 3, through a surface 34.

Preferably, the exterior dimensions of cams 20 and 21 are identical.

When the adjustment screw 24 causes cams 20 and 21 to come together, a wedge effect spaces plate 3 of abutment 4, by gliding of surfaces 28 on 29, 30 on 29, 32 on 31 and 34 on 33. The effect is inverted when cams 20 and 21 are spaced from one another. Spring 27 exerts a constant pressure on cams 20 and 21 and prevents screw 24 from turning in the absence of exterior action.

As appears from FIG. 8, a complementary means makes it possible to immobilize a cam 20, 21 in a desired adjustment position.

An immobilization screw 22, 23 extends first through a hole 35 of an upper wall of the linkage means 4, then a slit 36, 37 of cam 20, 21 to screw into ski 2. It suffices to tighten screw 22, 23 to block the position of cam 20, 21 with respect to the upper surface 6 of ski 2. Slit 36, 37 allows for the displacement of cam 20, 21 for immobilization.

The tightening occurs by a pressure exerted by the head of screw 22, 23 on the contact surface 38.

The pressure tightens cam 20, 21 on the upper surface 6 of ski 2. Each cam 20, 21 remains in contact with abutment 4, which is maintained on ski 2 by any means such as screws 39.

The adjustment mechanism 14 has the advantage of being economical, simple and efficient.

The adjustment structure which has just been described corresponds to a linkages 4 or 5 of the abutment type.

One could imagine other adjustment mechanism associated with other linkages.

Figure 9:
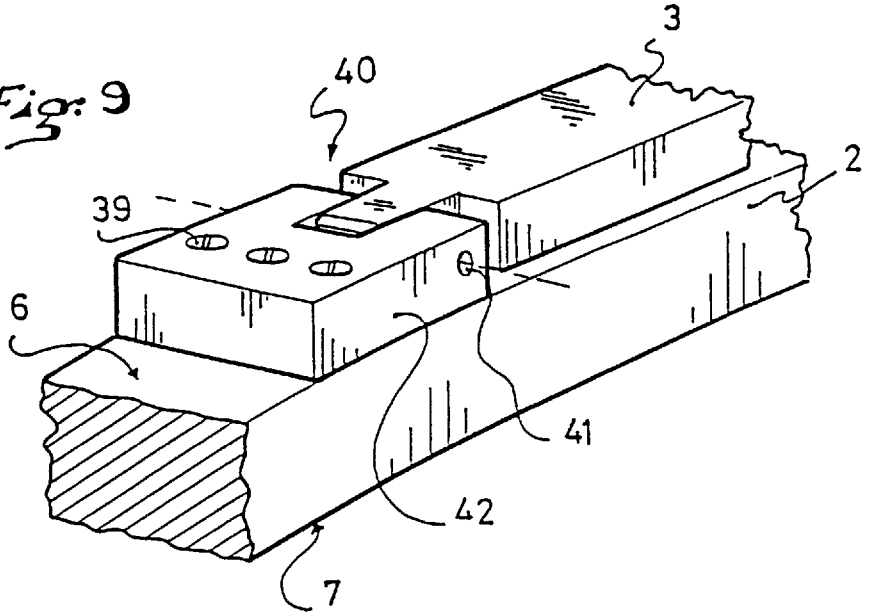
FIG. 9 shows in perspective a linkage journal of the plate on the ski.

Each linkages can for example be, as shown in FIG. 9, a journalled linkage 40. In this case, one end of plate 3 is journalled by an axis 41 on a base 42. Base 42 is affixed to the ski for example by screws 39. The end of plate 3 can pivot about axis 41 when it deforms.

Figure 10:
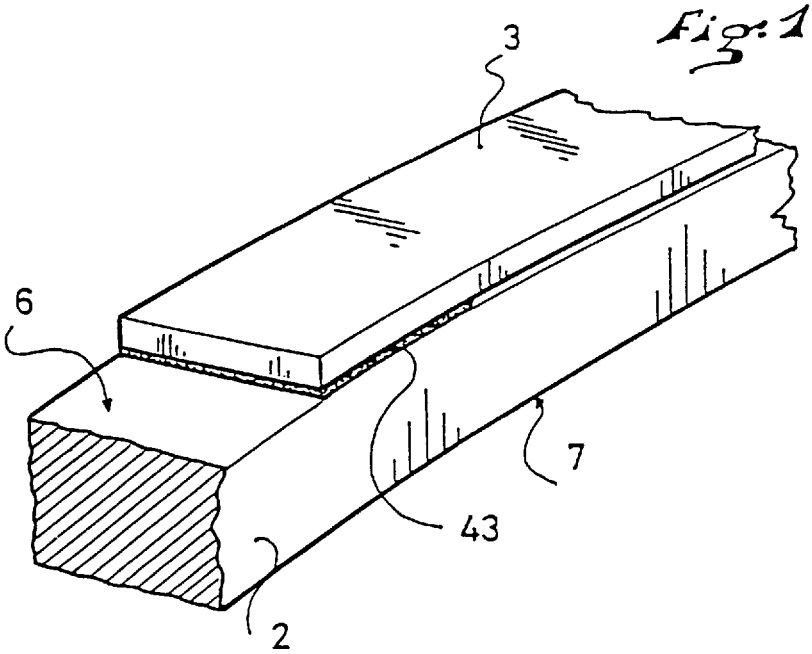
FIG. 10 shows in perspective a gluing of one end of the plate on a ski.

Each of the linkages 4 or 5 can further be, as shown in FIG. 10, a layer 43 made of a material having adhesive properties such as a glue. Layer 43 is provided only at the ends of plate 3 on the upper surface 6, in a manner such that a deformation can occur on plate 3.

The various linkages 4 and 5 of plate 3 on upper surface 6 of the ski make it possible to provide all possible assembly combinations. By way of non-limiting example, one could utilize an abutment 4 at the front and a journal 40 at the rear, which would have a tendency to favor deformation of the rear portion of plate 3, positioned preferably at the level of the heel of the skier.

One can likewise modify the mechanical characteristics of plate 3, for the examples of FIGS. 1–10, where the transverse section of plate 3 is substantially constant over its entire length, in a manner so as to have different flexional characteristics as a function of the length.

The material utilized for making such a plate 3 can be made of metal, a composite material containing fibers, a plastic or even wood.

Figure 11:
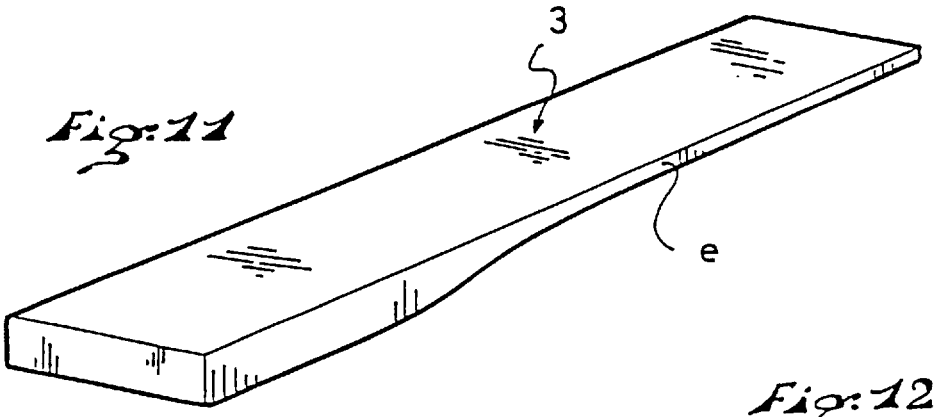
FIG. 11 shows a plate of variable cross section.

As shown in FIG. 11, a plate 3 can be obtained whose transverse section varies over a portion at least of the length. In this case, the deformation during the impulse phase is substantially localized in the zone of reduced thickness "e."

Preferably, the foot of the skier will be positioned, with respect to the plate 3, in a manner such that the rigidity in flexion of plate 3 toward the front of the foot is greater than the rigidity in flexion at the level of the heel 18.

Figure 12:
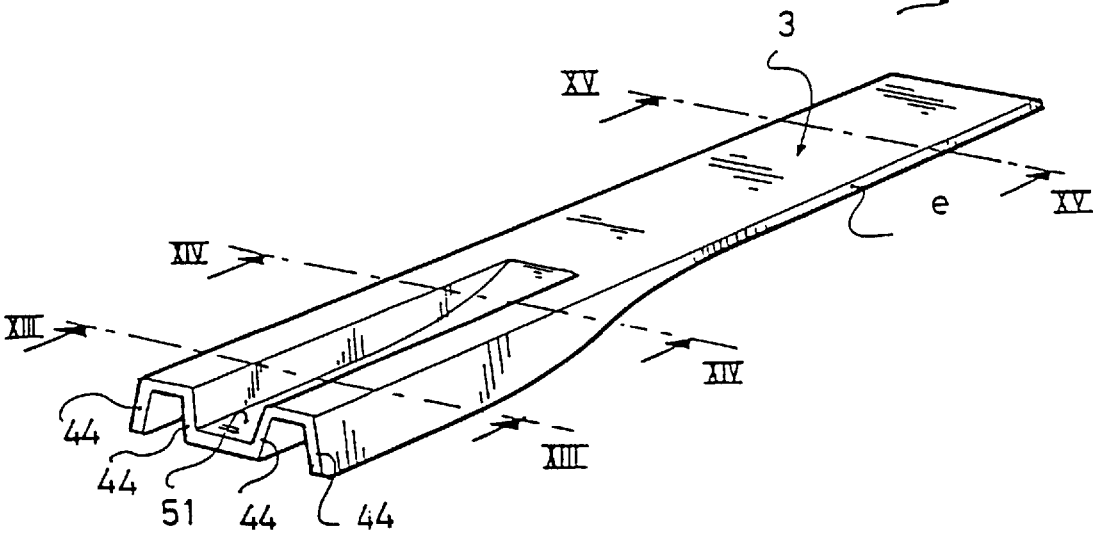
FIG. 12 shows an example of a ribbed plate.

As seen in FIG. 12, a localized increase of the rigidity in flexion of plate 3 can be obtained by ribs 44. These ribs 44 give a light plate structure; they can be used to reinforce only a certain length of plate 3 when their thickness varies.

Figure 13:
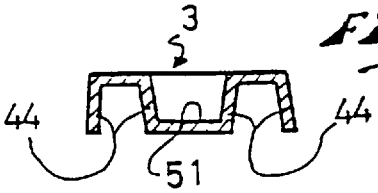
FIG. 13 is a cross section along XIII—XIII of FIG. 12.
Figure 14:
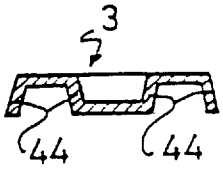
FIG. 14 is a cross section along XIV—XIV of FIG. 13.
Figure 15:
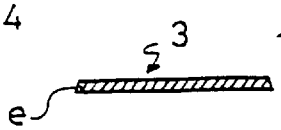
FIG. 15 is a cross section along XV—XV of FIG. 14.

Three cross-sections of FIG. 12 successively show a thick zone I of plate 3 in FIG. 13, an intermediate zone II of average thickness of plate 3 in FIG. 14, and a zone of reduced thickness III in FIG. 15.

The thickness of plate 3 in zones I, II, corresponds to the height of ribs 44.

In parallel with the use of a plate 3 of non-constant thickness, the ski 2 of assembly 1 advantageously has at least one variation of rigidity in flexion in the central zone, this variation of rigidity being provided to allow for an optimal flattening of the ski in the gripping zone (or wax chamber) thereof, during lifting of the heel (metatarsus support).

Figure 16:
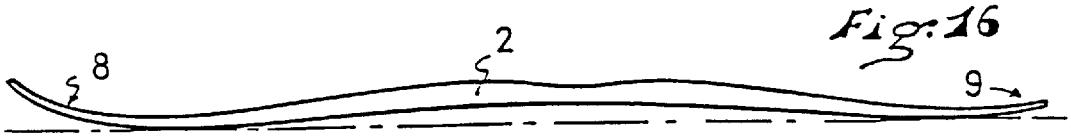
FIG. 16 shows a ski whose cross section of the central zone varies.

This variation of rigidity in flexion is preferably local and at a point and can be obtained, for example, by a variation of the transverse cross-section of the ski 2 in the central zone, as is shown in FIG. 16.

In this case, a diminution of thickness of ski 2 is obtained substantially at the level of the foot of the skier, and is translated into a decrease in the rigidity of the ski 2. This decrease is relative and corresponds to a difference with respect to a conventional ski such as in the assembly 1 of FIG. 1. It has been seen that an assembly 1 formed in particular of a plate 3 for increasing the stiffness of the ski during support of the heel and of a weakened ski 2, makes it possible to better exploit the dynamic effect generated by the successive deformations of plate 3, without having the disadvantages of systems known until this time.

Other embodiments of a localized weakening of ski 2 are shown successively, and in non-limiting fashion, in FIGS. 17, 18, 19 and 20.

Figure 17:
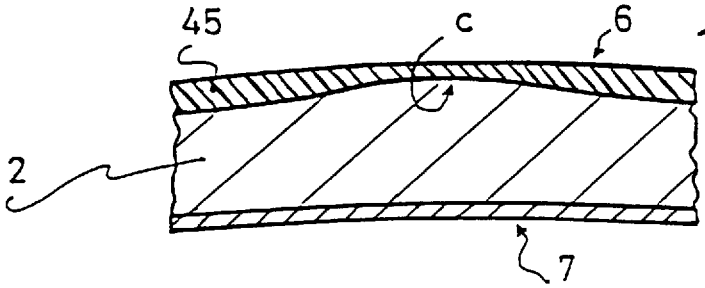
FIGS. 17–20 show the central zone of the ski, illustrating different embodiments for reducing the rigidity in flexion in a longitudinal direction of the ski.

In the case of FIG. 17, the upper layer 45 of ski 2 is made of at least one ribbon of fibers whose thickness or the number of layers is locally diminished or reduced in the central zone "c".

Figure 18:
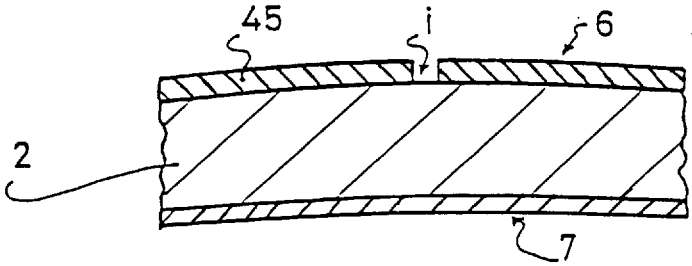

In the case of FIG. 18, the upper layer 45 of ski 2 is at least partially interrupted at "i" substantially in the central zone.

Figure 19:
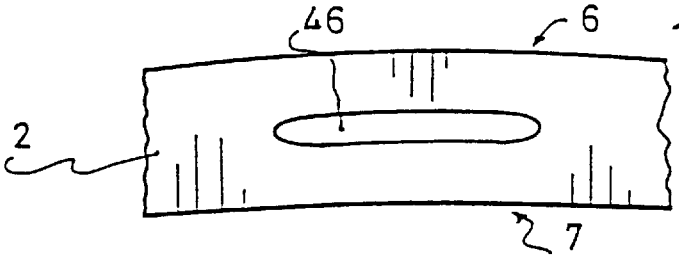

FIG. 19 proposes a weakening of the ski 2 obtained by providing a slit 46 between the upper surface 6 and the lower surface 7, substantially at the level of the central zone.

Figure 20:
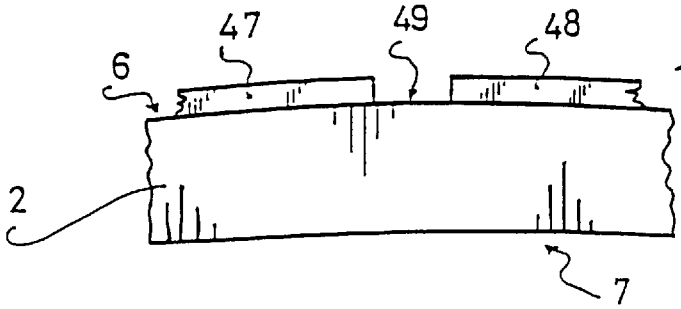

In the case of FIG. 20, the ski 2 shows a relative weakening by separation of two reinforcements 47 and 48 situated on the upper surface 6 of the ski 2, substantially at the level of the central zone, which leave between them a space 49 where the rigidity in flexion of the ski 2 is reduced. Indeed, each reinforcement acts to rigidify the portion of the ski on which it is affixed.

Whatever the mode of weakening selected to reduce substantially the rigidity in flexion of ski 2 of assembly 1 in the central zone, the structure of the assembly is constructed in such a manner that the deformation of plate 3 is produced substantially under the heel of the skier.

Figure 21:
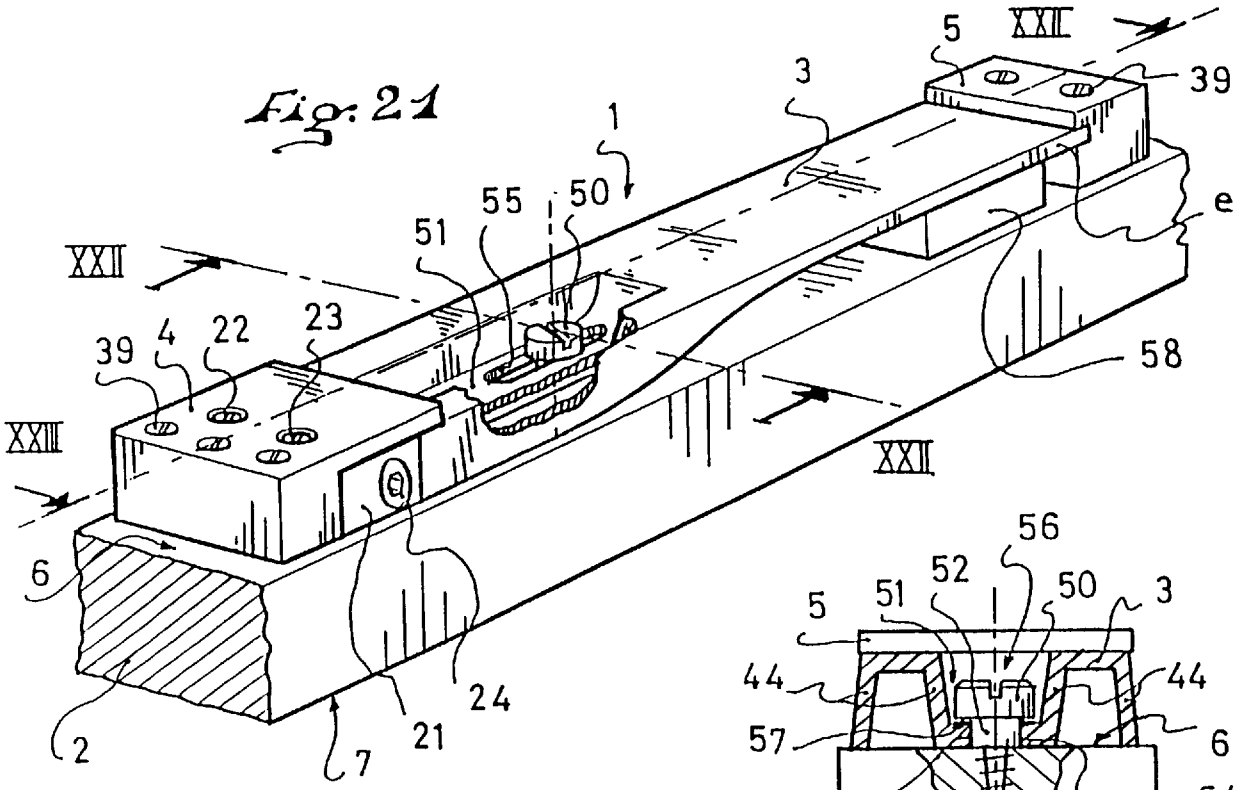
FIG. 21 is a perspective view of an assembly according to one preferred embodiment.

An assembly 1 according to a preferred embodiment is shown in perspective in FIG. 21. Plate 3 is positioned substantially on the upper surface 6 of ski 2 between two front and rear abutments 4 and 5. These abutments maintain plate 3 in a longitudinal direction and in a vertical direction with respect to ski 2.

At least one complementary means 50, affixed to ski 2, referred to as an anti-lifting means, makes it possible to prevent the lifting of plate 3 with respect to ski 2 over at least a part of its length. This means 50 can for example be a shouldered screw affixed in ski 2.

Figure 22:
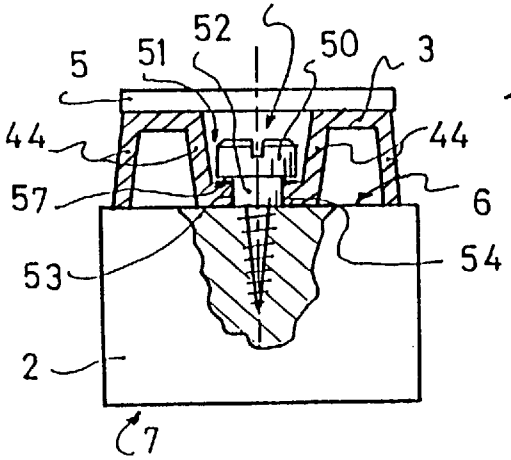
FIG. 22 is a cross section along XXII—XXII of FIG. 21.

As shown in FIG. 22, the shouldered screw 50 is positioned in a groove 51 provided in plate 3, which avoids it extending above plate 3. A shoulder 52 of screw 50 is tangent to the wall 53, 54 of a slit 55 provided in the end of groove 51 of plate 3. This shoulder 52 prevents plate 3 from being laterally displaced with-respect to ski 2 because the width of slit 55 is substantially equal to the diameter of shoulder 52.

Figure 23:
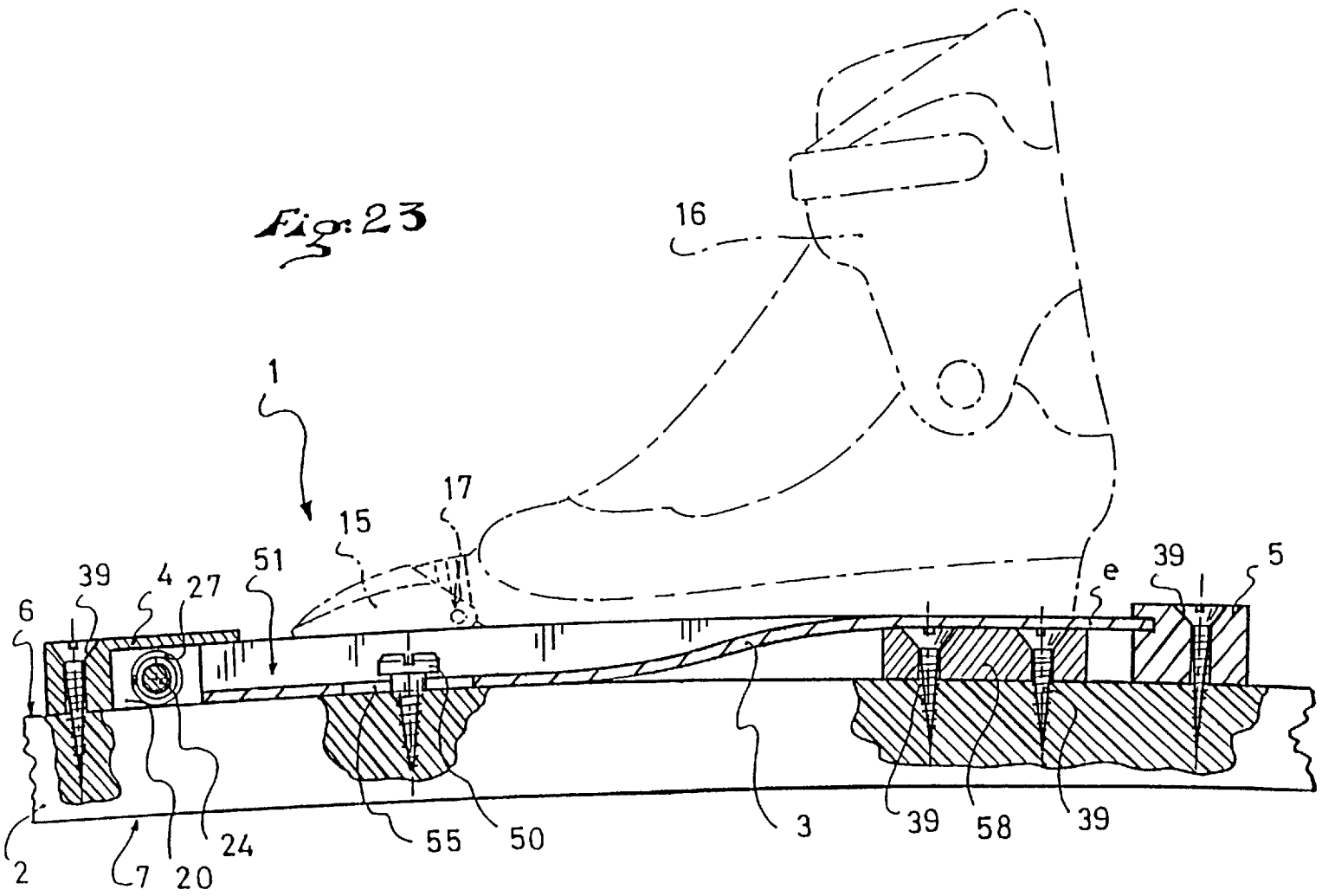
FIG. 23 is a cross section along XXIII—XXIII of FIG. 21.

Head 56 of shoulder screw 50 extends beyond each side of slit 55 and prevents, by virtue of the bottom of its head 57, a spacing in the vertical direction of plate 3 with respect to ski 2. Nevertheless, as may be seen in FIG. 23, slit 55 provided in the longitudinal direction of ski 2 and plate 3 allows for a relative displacement of the plate 3 with respect to the upper surface 6 of the ski 2. This phenomenon occurs when the camber of the ski changes, to pass alternatively from a gliding phase to an impulse phase.

Preferably, the shouldered screw 50 is positioned in the support zone of the metatarsus of the foot.

A wedge 58, affixed to the ski 2 for example by screws 39, supports the rear portion of small thickness of plate 3.

In a complementary fashion, one can add at least one joint of flexible material, such as rubber or silicone, on each side of plate 3.

This joint, not shown, serves to prevent any foreign bodies from wedging themselves between plate 3 and the upper surface 6 of the ski 2.

Figure 26:
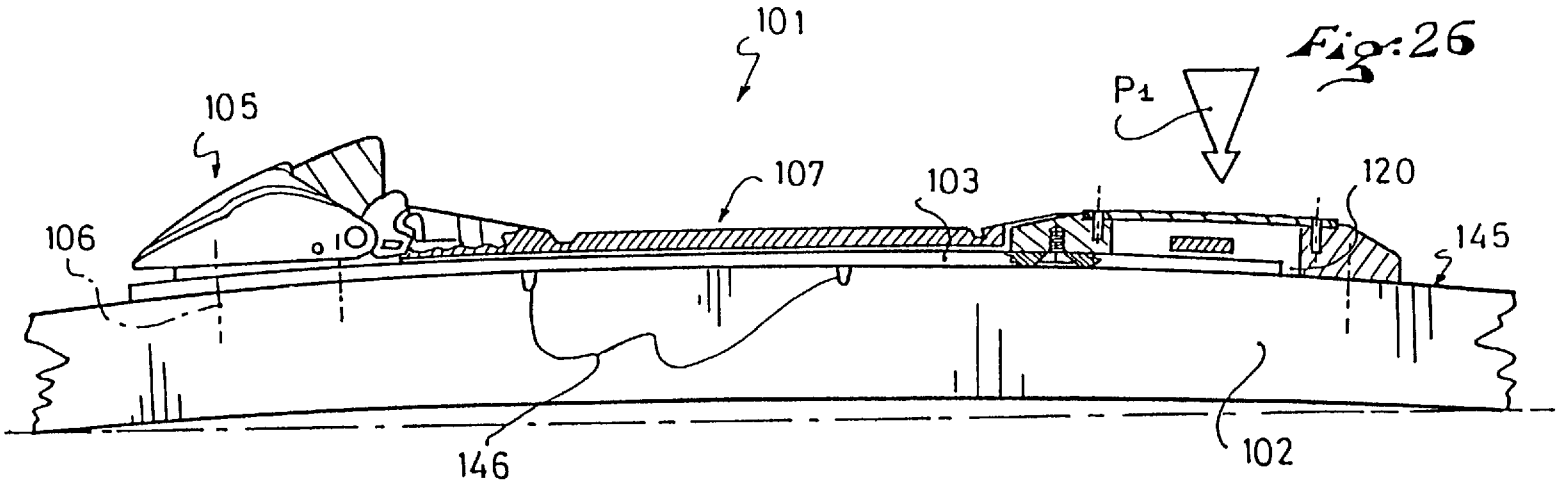
FIG. 26 is a partial cross sectional view, similar to FIG. 23, of an assembly according to another embodiment in the gliding phase.
Figure 27:
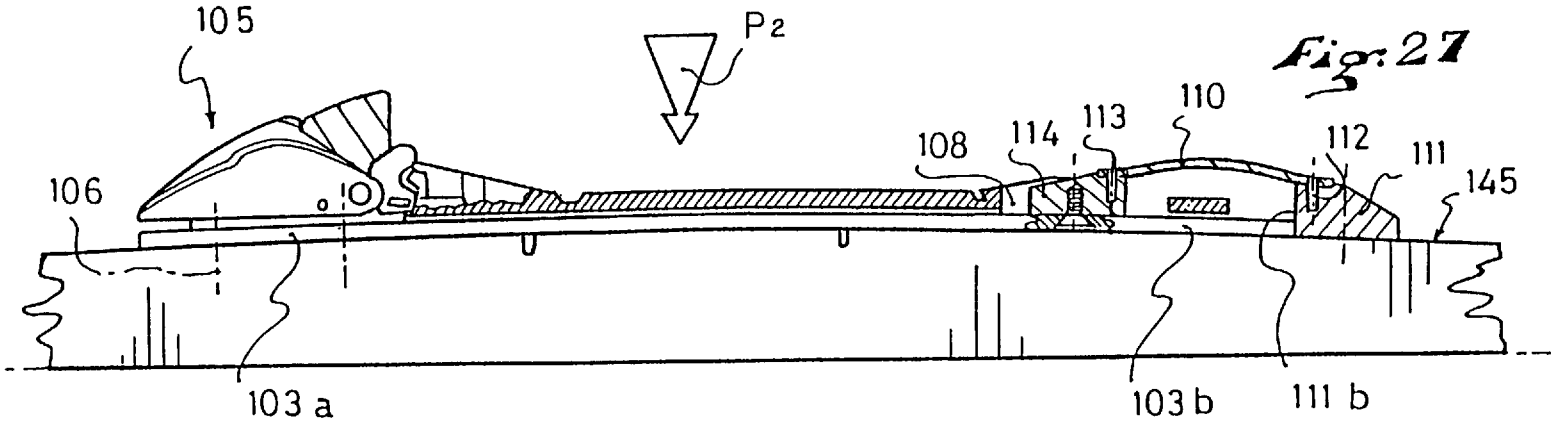
FIG. 27 is a view similar to FIG. 26 of an assembly in the impulse phase.
Figure 28:
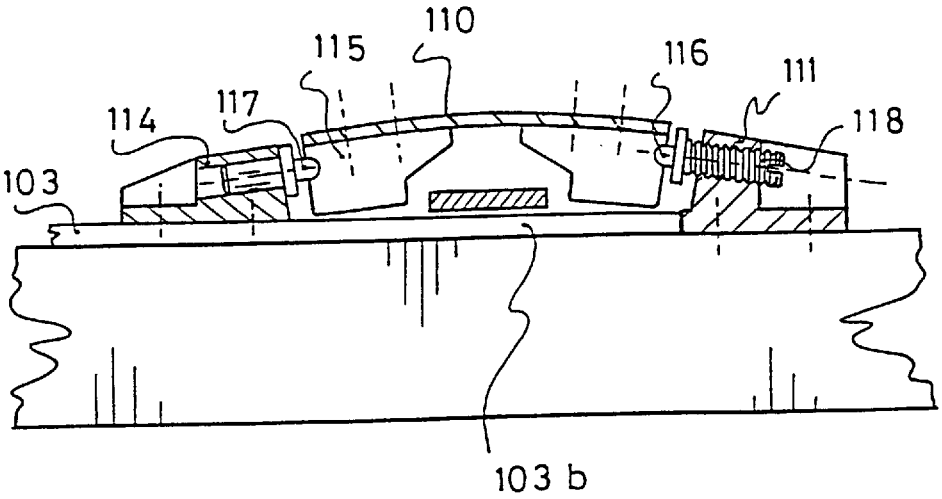
FIG. 28 is a detailed view of the embodiment of the assembly of FIGS. 26 and 27.

FIGS. 26–28 illustrate example 101 of a preferred embodiment of the invention allowing for a perfect integration thereof with bindings 105 of the cross-country ski, of the type known commercially as SNS Profile, i.e., comprising a long guiding edge 107 extending under the entire length of the foot.

Ski 102 is provided in its upper layer 145 with two weakenings made in this case out of two transverse slits 146 positioned substantially on both sides of the gripping zone of the ski commonly referred to as "wax chamber".

The role of these two transverse slits 146 is, as previously explained, to diminish the stiffness of a ski of a known type and to allow for an optimum "crushing" of the wax chamber thereof, i.e., an optimal flattening thereof against the ground during the impulse phase in the course of which a force P2 is exerted by the skier by pressing with the foot at the level of the metatarsus (FIG. 27).

The positioning of these transverse slits 146 is determined as a function of the ski. Of course, these transverse slits can in the present case be replaced by any other weakening means described previously, or even be eliminated entirely.

Like in the preceding examples, a longitudinal plate 103 is provided to increase the rigidity in flexion of the ski during the gliding phase.

This plate 103, which is preferably made of a composite material but can likewise be formed of any other material, is affixed to the ski, at its front end 103*a*, by means of screws 106 of binding 105, and extends under the entire length of this binding 105 and its guiding edge 107 by covering the entire weakened zone of the ski and particularly the two slits 146.

The rear end 103*b* of the plate 103 is free in translation and can thus slide with respect to the ski during the flexions thereof, until abutting against a linkage block 111 which forms an abutment and is affixed, in a known manner and for example by screws, on the ski.

Means known in themselves and previously described with reference to FIGS. 21 and 22 can be provided to allow for the sliding of plate 103 with respect to the ski while preventing a displacement in a vertical direction or a lifting thereof.

On the abutment 111 is affixed, for example by means of a screw 112, the end of an activation plate 110. This plate 110 is furthermore affixed at its other end, by means of a pin 113, to the plate 103 by means of another abutment element 114 which is itself affixed on this plate.

The attachment pins 112, 113, of plate 110 can be replaced by other linkage means, including simple abutments.

Plate 110 extends into a longitudinal opening 108 arranged in the guiding edge 107.

In fact, the activation plate 110 forms a linkage of the rear end 103*b* of the rigidification plate 103 to the ski.

Abutment 111 is selected in a manner so as to provide a play between the rear end 103*b* of the plate and the abutment surface 111*b*, in the cambered position of the ski (FIG. 26), and does not enter into abutment with this end 103*b* except beyond a "flat" position of the ski.

The operation of the assembly is the same as that of the embodiments previously described.

When a force P2 is exerted by the foot at the level of the metatarsus, during a lifting of the heel, the plate 103 accompanies the downward bending of the ski 102, which presses flat against the ground. In the course of this displacement, plate 103 slides until it abuts against the abutment element 111, its coming into abutment serving to rigidify again the ski and stopping the downward flexion of the ski at a predetermined value sufficient for pressing the wax chamber whatever the terrain and the snow.

Simultaneously, the activation plate 110, which does not have a freedom of movement in the longitudinal direction and is connected on the one hand to the plate 103, and on the other hand to the ski, deforms by buckling upwardly through the opening 108 of the guiding edge.

Once the impulse phase has ended, the skier replaces his foot flat, and exerts, by pressing on his heel, a force P1 on the lifted portion of the activation plate 110, which results in stiffening the ski by the tensioning of plates 103, and 110, and in giving it back its camber as shown in FIG. 26.

With respect to the embodiments previously described, this embodiment presents the advantage of an excellent integration in the attachment apparatus, only the activation portion 110 appearing on the outside, and of thus being both more aesthetic and less sensitive to the possible presence of snow.

FIG. 28 illustrates an example of mounting between abutments of the activation plate 110. In this case, the plate is provided at each end of a linkage block 115 cooperating with axial slightly inclined fingers 116 and 117 of the linkage blocks, respectively 111 and 114.

In this case, finger 116 is mounted at the end of a screw 118 allowing by means of its activation to apply a more or less substantial pre-stress on the activation plate 110.

We will now proceed, in a general manner, to compare the diagrams taken during the use of a classic ski and a ski provided with the means according to the invention.

Figure 24:
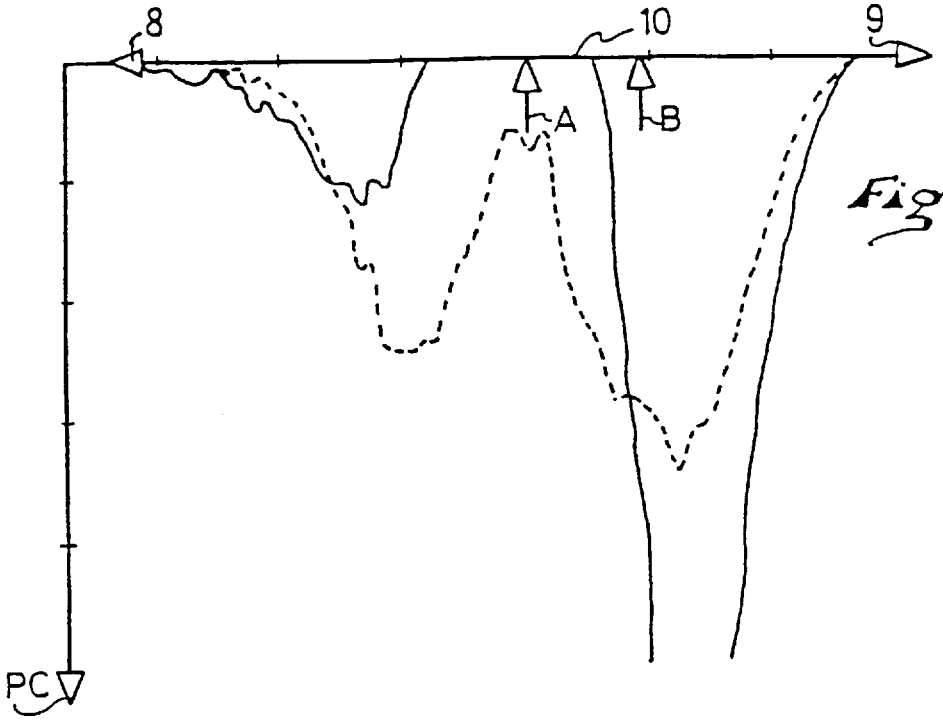
FIGS. 24 and 25 show diagrams illustrating the distribution of contact pressures between the heel and the metatarsus of the foot, respectively according to the known state of the art and the invention.

For a classic ski adapted essentially for alternating stepping, it is seen, as shown in FIG. 24, that this pressure distribution along the length of the ski 2 is not ideal. This diagram shows the contact pressure PC in along the ordinate, as a function of the position of the ski on the abscissa, between the front end 8 and heel 9 of the ski, respectively in the impulse phase, in dashed lines, and in the gliding phase, in solid lines. The support points during impulse and of the heel are respectively referred to as A and B. It will be observed that if, in the gliding phase or the support phase of the heel, the wax chamber 10 or zero pressure zone, exists clearly, during the impulse phase (dashed lines), the pressure, that is obtained at the level of impulse point A, is in fact distributed on both sides of this point in a very wide and diffuse manner on the one, hand, and with relatively small intensity, in the zone of the wax chamber 10 on the other hand, which considerably reduces the effectiveness of the impulse.

Figure 25:
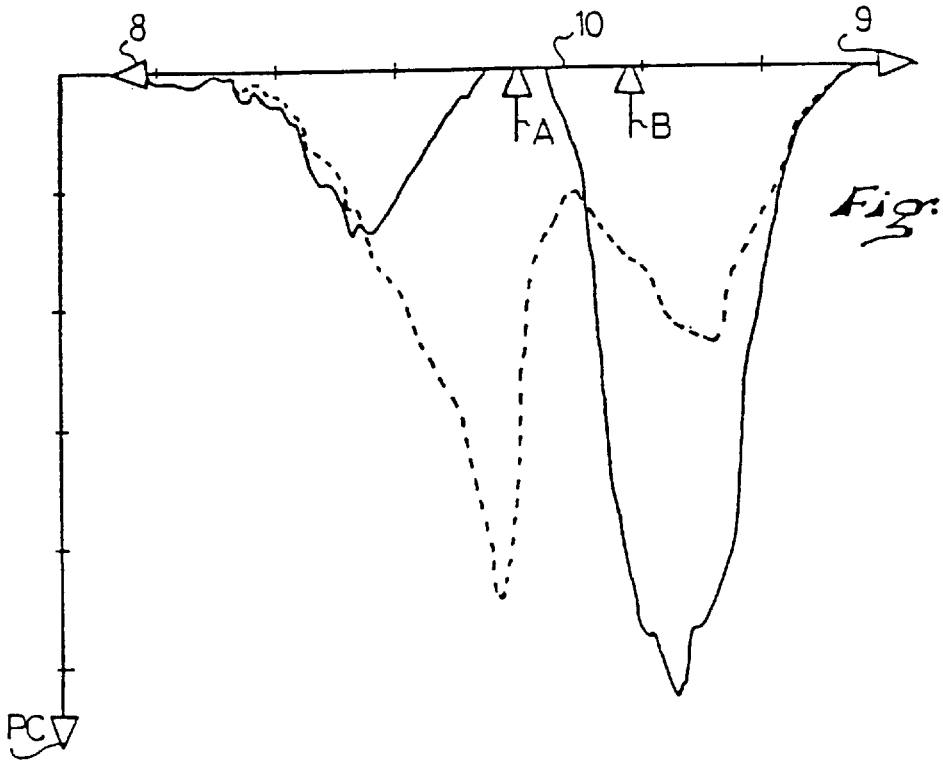

Compared to the diagram of FIG. 24, the diagram of FIG. 25 shows, in dashed lines, with a ski provided with means for acting on the rigidity in flexion according to the invention, the advantageous proportions in which the impulse curve reaches a value of force exerted on the ski, much greater in this phase (4.5 kg instead of 2.2 kg, or more than double), while in the gliding phase, in solid lines, the force is diminished.

Of course, the invention is not limited to the embodiments thus described, and includes all technical equivalents which may be included within the scope of the claims which follow.

One can contemplate, for example, a hydraulic or pneumatic system, in which a flexible envelope or a piston activated by the heel 18 of the foot causes a change of the curvature of the ski 2 as result of a fluid movement.

Finally, although the invention has been described with reference of particular means, materials and embodiments, it is to be understood that the invention is not limited to the particulars disclosed and extends to all equivalents within the scope of the claims.

What is claimed is:

1. A cross-country ski assembly for practicing cross-country skiing, including a gliding phase and an impulse phase, said assembly comprising:

a ski including an upper surface and a lower surface, said lower surface defining a central zone, said ski having a structure whereby said central zone of said lower surface is adapted to become alternately spaced from and in contact with a ski supporting surface during use of the ski, whereby, during said impulse phase, said central zone contacts said ski supporting surface and, during said gliding phase, said central zone is spaced from said ski supporting surface, said ski having a predeterminate rigidity in flexion; and a dynamic rigidification device comprising means for establishing a rigidity higher than said predeterminate rigidity during said gliding phase and for resuming said predeterminate rigidity during said impulse phase.

2. A cross-country ski assembly according to claim 1, wherein:

said means for establishing a rigidity higher than said predeterminate rigidity during said gliding phase and for resuming said predeterminate rigidity during said impulse phase comprises:

means for establishing said higher rigidity in response to lowering a heel of a skier toward said upper surface of said ski; and means for resuming said predeterminate rigidity in response to raising said heel of said skier from said upper surface of said ski.

3. A cross-country ski assembly according to claim 1, wherein:

said dynamic rigidification device comprises:

at least one plate having a front end and a rear end, said plate being positioned above said upper surface and above said central zone of said lower surface; and a front linkage for linking said front end of said plate to said ski and a rear linkage for linking said rear end of said plate to said ski.

4. A cross-country ski assembly according to claim 3, wherein:

said plate has a predetermined length between said front end and said rear end; and said front linkage and said rear linkage are spaced apart, in the absence of said plate, a distance equal to said predetermined length of said plate, whereby said plate is in a longitudinally non-prestressed condition when linked to said ski by said front linkage and said rear linkage.

5. A cross-country ski assembly according to claim 3, wherein:

said plate has a predetermined length between said front end and said rear end; and said front linkage and said rear linkage are spaced apart, in the absence of said plate, a distance less than said predetermined length of said plate, whereby said plate is in a longitudinally prestressed condition when linked to said ski by said front linkage and said rear linkage.

6. A cross-country ski assembly according to claim 3, wherein:

said plate has a rigidity in flexion in a front portion, proximate an area of support of a front of a skier's foot, greater than a rigidity in flexion in a rear portion, proximate an area of support of a heel of the skier's foot.

7. A cross-country ski assembly according to claim 1, wherein:

said ski includes means for reducing stiffness of said ski above said central zone of said lower surface.

8. A cross-country ski assembly according to claim 7, wherein:

said means for reducing stiffness comprise at least one slit between said upper surface and said lower surface of said ski.

9. A cross-country ski assembly according to claim 1 wherein:

said upper surface of said ski comprises a support surface for forces transmitted by a foot of a skier;

said ski includes a front end zone comprising a tip and a rear end zone comprising a heel;

said central zone comprises a gripping zone;

whereby said gripping zone is adapted to be spaced from a ski supporting surface during the gliding phase, as the heel of the skier is lowered toward said support surface, and said gripping zone is adapted to contact the ski supporting surface during the impulse phase, as the heel of the skier is raised from said support surface;

said ski has a structure conferring a variation in flexional rigidity at said central zone.

10. A ski according to claim 9, wherein:

said structure includes a variation in transverse cross-sectional shape in said central zone.

11. A ski according to claim 9, wherein:

said ski includes an upper layer of fibers extending through and beyond said central zone of said ski, said upper layer having a reduced thickness in said central zone.

12. A ski according to claim 9, wherein:

said ski includes an upper layer extending through and beyond said central zone of said ski, said upper layer being interrupted in said central zone.

13. A ski according to claim 9, wherein:

said ski includes at least one slit between said upper surface and said lower surface of said ski substantially in said central zone.

14. A ski according to claim 9, wherein:

said ski includes at least two longitudinally extending reinforcements attached to said upper surface substantially in said central zone.

15. A cross-country ski assembly for practicing cross-country skiing, including a gliding phase and an impulse phase, said assembly comprising:

a ski including:

an upper surface comprising a support surface for forces transmitted by a foot of a skier;

a lower surface adapted to contact a ski supporting surface;

a front end zone comprising a tip;

a rear end zone comprising a heel;

a central zone between said front end zone and said rear end zone, said lower surface in said central zone comprising a gripping zone;

said ski having a predeterminate camber and a predeterminate rigidity in flexion, whereby said gripping zone is adapted to be spaced from a ski supporting surface during the gliding phase, as the heel of the skier is lowered toward said support surface, and said gripping zone is adapted to contact the ski supporting surface during the impulse phase, as the heel of the skier is raised from said support surface; and a dynamic rigidification device comprising at least one plate having opposite extremities and linkages for linking respective ones of said opposite extremities of said plate to said upper surface of said ski, said dynamic rigidification device and said ski defining a structure having a rigidity in flexion during the gliding phase greater than said predeterminate rigidity of said ski.

16. A cross-country ski assembly according to claim 15, wherein:

said opposite extremities of said plate comprise a front end and a rear end and said linkages comprise a front linkage and a rear linkage for linking said front end of said plate and said rear end of said plate, respectively, to said ski;

said plate has a predetermined length between said front end and said rear end; and said front linkage and said rear linkage are spaced apart, in the absence of said plate, a distance equal to said predetermined length of said plate, whereby said plate is not longitudinally pre-stressed when linked to said ski by said front linkage and said rear linkage.

17. A cross-country ski assembly according to claim 16, further comprising:

an adjustment mechanism for adjusting a longitudinal pre-stressing of said plate.

18. A cross-country ski assembly according to claim 17, wherein:

said adjustment mechanism includes means for taking up play between said plate and one of said linkages for having no longitudinally directed force applied to said plate by said one of said linkages.

19. A cross-country ski assembly according to claim 17, wherein:

said adjustment mechanism comprises:

at least one cam mounted for movement with respect to said ski, said cam being positioned between one of said linkages and said plate; and a blockage element for selectively immobilizing said cam in a desired position.

20. A cross-country ski assembly according to claim 15, wherein:

said opposite extremities of said plate comprise a front end and a rear end and said linkages comprise a front linkage and a rear linkage for linking said front end of said plate and said rear end of said plate, respectively, to said ski;

said plate has a predetermined length between said front end and said rear end; and said front linkage and said rear linkage are spaced apart, in the absence of said plate, a distance less than said predetermined length of said plate, whereby said plate is longitudinally pre-stressed when linked to said ski by said front linkage and said rear linkage.

21. A cross-country ski assembly according to claim 20, further comprising:

an adjustment mechanism for adjusting a longitudinal pre-stressing of said plate.

22. A cross-country ski assembly according to claim 21, wherein:

said adjustment mechanism includes means for taking up play between said plate and one of said linkages for having no longitudinally directed force applied to said plate by said one of said linkages.

23. A cross-country ski assembly according to claim 21, wherein:

said adjustment mechanism comprises:

at least one cam mounted for movement with respect to said ski, said cam being positioned between one of said linkages and said plate; and a blockage element for selectively immobilizing said cam in a desired position.

24. A cross-country ski assembly according to claim 15, wherein:

at least one of said linkages comprises an abutment, said abutment acting on one of said extremities of said plate at least in a vertical direction and in a horizontal direction.

25. A cross-country ski assembly according to claim 15, wherein:

at least one of said linkages includes a journal for enabling at least one of said extremities of said plate to pivot with respect to said ski.

26. A cross-country ski assembly according to claim 15, wherein:

at least one of said linkages is a layer of adhesive for securing at least one of said extremities of said plate to said ski.

27. A cross-country ski assembly according to claim 15, wherein:

said plate has a predeterminate length; and said plate has a thickness that varies along at least a portion of said length of said plate.

28. A cross-country ski assembly according to claim 15, wherein:

said plate has a rigidity in flexion in a front portion, proximate an area of support of a front of a skier's foot, greater than a rigidity in flexion in a rear portion, proximate an area of support of a heel of the skier's foot.

29. A cross-country ski assembly according to claim 28, wherein:

said plate includes a longitudinal rib along at least said front portion of said plate.

30. A cross-country ski assembly according to claim 15, wherein:

said plate includes a longitudinal rib along at least a portion of said plate for increasing rigidity of said plate in at least said portion.

31. A cross-country ski assembly according to claim 15, wherein:

said rigidification device further includes an anti-lifting means attached to said ski for preventing lifting of said plate with respect to said ski over at least a portion of a length of said ski.

32. A cross-country ski assembly according to claim 31, wherein:

said anti-lifting device is located in a support area corresponding to a zone for supporting a metatarsus of the foot of the skier.

33. A cross-country ski assembly according to claim 31, wherein:

an opening is formed through a thickness of said plate over at least a portion of a length of said plate; and said anti-lifting device includes a portion extending through said opening and retains said plate.

34. A cross-country ski assembly according to claim 15, wherein:

said plate includes a pair of opposite lateral sides; and said assembly further comprising a joint of material extending along each of said lateral sides of said plate for preventing foreign matter from becoming wedged between said plate and said ski.

35. A cross-country ski assembly according to claim 15, wherein:

said ski has a structure conferring a variation in flexional rigidity at said central zone.

36. A cross-country ski assembly according to claim 35, wherein:

said structure includes a variation in transverse cross-sectional shape in said central zone.

37. A cross-country ski assembly according to claim 35, wherein:

said ski includes an upper layer of fibers extending through and beyond said central zone of said ski, said upper layer having a reduced thickness in said central zone.

38. A cross-country ski assembly according to claim 35, wherein:

said ski includes an upper layer extending through and beyond said central zone of said ski, said upper layer being interrupted in said central zone.

39. A cross-country ski assembly according to claim 35, wherein:

said ski includes at least one slit between said upper surface and said lower surface of said ski substantially in said central zone.

40. A cross-country ski assembly according to claim 35, wherein:

said ski includes at least two longitudinally extending reinforcements attached to said upper surface substantially in said central zone.

* * * * *